US009770051B2

(12) United States Patent
Tschan, II

(10) Patent No.: US 9,770,051 B2
(45) Date of Patent: Sep. 26, 2017

(54) CIGAR BAND

(71) Applicant: Robert E. Tschan, II, Henderson, NV (US)

(72) Inventor: Robert E. Tschan, II, Henderson, NV (US)

( * ) Notice: Subject to any disclaimer, the term of this patent is extended or adjusted under 35 U.S.C. 154(b) by 0 days.

(21) Appl. No.: 14/601,502

(22) Filed: Jan. 21, 2015

(65) Prior Publication Data

US 2015/0201672 A1 Jul. 23, 2015

Related U.S. Application Data

(60) Provisional application No. 61/930,318, filed on Jan. 22, 2014.

(51) Int. Cl.

| | |
|---|---|
| ***A24D 1/16*** | (2006.01) |
| *A24D 1/02* | (2006.01) |
| *A24F 13/22* | (2006.01) |
| *A24F 13/08* | (2006.01) |

(52) U.S. Cl.

CPC ..... *A24D 1/16* (2013.01); *A24D 1/02* (2013.01); *A24F 13/08* (2013.01); *A24F 13/22* (2013.01)

(58) Field of Classification Search

CPC ... A24D 1/16; A45D 8/20; A45D 8/24; A45D 8/26; A45D 8/00; Y10T 24/1408

USPC ..... 40/321; 131/187–190

See application file for complete search history.

(56) References Cited

U.S. PATENT DOCUMENTS

| | | | | | |
|---|---|---|---|---|---|
| 971,519 | A | * | 10/1910 | Brannen | 132/107 |
| 1,402,513 | A | * | 1/1922 | Kampfe | 40/321 |
| 1,405,148 | A | * | 1/1922 | Nagel | 40/321 |
| 1,477,144 | A | * | 12/1923 | Malocsay | 40/321 |
| 1,597,894 | A | * | 8/1926 | Hutter | 40/321 |
| 1,618,983 | A | * | 3/1927 | Intemann | 40/321 |
| 1,647,906 | A | * | 11/1927 | Dorman et al. | 40/321 |
| 1,796,711 | A | * | 3/1931 | Hill | 40/321 |
| 3,565,084 | A | * | 2/1971 | Jean Vuillard | 132/279 |
| 5,535,765 | A | * | 7/1996 | Takashima | 132/273 |
| 5,590,668 | A | * | 1/1997 | Macy | 132/200 |
| 5,623,890 | A | * | 4/1997 | Lenske | A62B 3/00 116/205 |
| 6,079,135 | A | * | 6/2000 | Ruiz | G09F 3/205 40/316 |
| 6,311,699 | B1 | * | 11/2001 | Horman | 132/278 |
| 6,311,700 | B1 | * | 11/2001 | Yeh | 132/279 |
| D463,621 | S | * | 9/2002 | Tobin | D28/41 |
| D526,442 | S | * | 8/2006 | Kim | D28/41 |

(Continued)

*Primary Examiner* — Shin Kim

(74) *Attorney, Agent, or Firm* — Newman Law, LLC

(57) ABSTRACT

This disclosure provides a cigar band comprising two annular-shaped halves, a clasp mechanism, a hinge mechanism, and at least one spring mechanism. The clasp mechanism is along one side edge of each annular-shaped half and is configured to allow for the separation and union of the two halves along the one side edge. The hinge mechanism is along the opposing side edge of each annular-shaped half and is configured to allow for the movement of the two halves about an axis. The cigar band also has at least one spring mechanism attached to at least one annular-shaped half. The cigar band is configured to open about the axis and maintain a cigar within the space defined by the two annular-shaped halves as a result of the pressure of the at least one spring mechanism once the cigar band is closed.

18 Claims, 5 Drawing Sheets

(56) References Cited

U.S. PATENT DOCUMENTS

| | | | | |
|---|---|---|---|---|
| D565,729 | S * | 4/2008 | Stephens | D24/128 |
| D573,255 | S * | 7/2008 | Stephens | D24/128 |
| 7,882,844 | B2 * | 2/2011 | Chininis et al. | 132/279 |
| 7,963,289 | B1 * | 6/2011 | King | 132/200 |
| 2006/0073431 | A1 * | 4/2006 | Brown | F23Q 2/163 431/129 |
| 2007/0079846 | A1 * | 4/2007 | Keating | 132/278 |
| 2008/0251264 | A1 * | 10/2008 | Eller | A62C 2/06 169/48 |
| 2009/0255553 | A1 * | 10/2009 | Hsu | 132/277 |
| 2010/0108091 | A1 * | 5/2010 | Lay | 132/279 |
| 2014/0283869 | A1 * | 9/2014 | Sonstegard et al. | 132/275 |
| 2014/0290682 | A1 * | 10/2014 | Wendschuh | 132/200 |
| 2015/0201672 | A1 * | 7/2015 | Tschan, II | 40/321 |

* cited by examiner

CIGAR BAND

CROSS REFERENCE TO RELATED APPLICATIONS

This application claims the benefit of U.S. Provisional Application Ser. No. 61/930,318 titled A JEWELED CIGAR BAND WITH GEMS OF ANY TYPES USING MAGNETS FOR THE CONNECTION, filed Jan. 22, 2014, the entirety of which is incorporated herein by reference.

COPYRIGHT NOTICE

A portion of this disclosure contains material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The present invention relates generally to non-disposable cigar bands and particularly to cigar bands having various integrated clasp, hinge, and spring mechanisms.

BACKGROUND OF THE DISCLOSURE

Cigars have a long standing history dating back to the European discovery of the Americas during the 15 th century. Over the centuries many of aspects related to the manufacture and marketing of cigars have matured and developed. In particular, cigar rings have commonly represented the origin and brand of cigars to consumers for centuries.

Originally, cigar rings were made of simple paper construction and plant-based glue. Cigar rings gained popularity in the 1800s to ensure that consumers could identify branded cigars. Over the decades cigar rings have become collector's items. Cigar fans over the years have kept cigar rings as mementos of their cigar experiences. Even to a casual cigar smoker the cigar band may serve as a keepsake of the moment or event associated with the cigar.

Unfortunately, the traditional paper cigar band lacks the permanence and durability of being a true keepsake or memento for a treasured moment represented by a cigar. Furthermore, a traditional cigar band lacks the strength or durability to allow a cigar smoker to use the cigar band to hold the cigar during smoking. The creation of a cigar band with a durable, permanent construction would allow for its use for an indefinite period of time.

It is an object of the present disclosure to address or at least ameliorate some of the above disadvantages.

SUMMARY OF THE DISCLOSURE

This disclosure provides a cigar band comprising two annular-shaped halves, a clasp mechanism, a hinge mechanism, and at least one spring mechanism. The clasp mechanism is along one side edge of each annular-shaped half and is configured to allow for the separation and union of the two halves along the one side edge. The hinge mechanism is along the opposing side edge of each annular-shaped half and is configured to allow for the movement of the two halves about an axis. The cigar band also has at least one spring mechanism attached to at least one annular-shaped half. The cigar band is configured to open about the axis and maintain a cigar within the space defined by the two annular-shaped halves as a result of the pressure of the at least one spring mechanism once the cigar band is closed.

This disclosure also provides a cigar band comprising two annular-shaped halves, a clasp mechanism, and a hinge mechanism. The clasp mechanism is along one side edge of each annular-shaped half and is configured to allow for the separation and union of the two annular-shaped halves along the one side. The hinge mechanism is along the opposing side of each annular-shaped half and is configured to allow for the movement of the two annular-shaped halves about an axis. The cigar band is configured to maintain a cigar within the space defined by the two annular-shaped halves once the cigar band is closed.

This disclosure also provides a cigar band comprising two annular-shaped halves, a magnet, and at least one spring mechanism. The magnet is positioned along the side edge of at least one annular-shaped half and is configured to lock through the placement of the annular-shaped halves within proximity to one another. The at least one spring mechanism is attached to at least one annular-shaped half. The cigar band is configured to maintain a cigar within the space defined by the two annular-shaped halves as a result of the pressure of the at least one spring mechanism once the cigar band is closed.

BRIEF DESCRIPTION OF THE DRAWINGS

Other advantages within the present disclosure will be readily appreciated as the same becomes better understood by reference to the following detailed description when considered in connection with the accompanying drawings.

Corresponding reference characters indicate corresponding parts throughout the drawings.

DETAILED DESCRIPTION OF THE DRAWINGS

With reference to the drawings and in operation, the present disclosure overcomes at least some of the disadvantages by providing a reusable cigar band having a clasp mechanism, a hinge mechanism, and a spring mechanism. The use of the three mechanisms allows for the secure grip of a cigar through the cigar band as well as providing additional branding opportunities and decorative appeal to the cigar.

Figure 1:
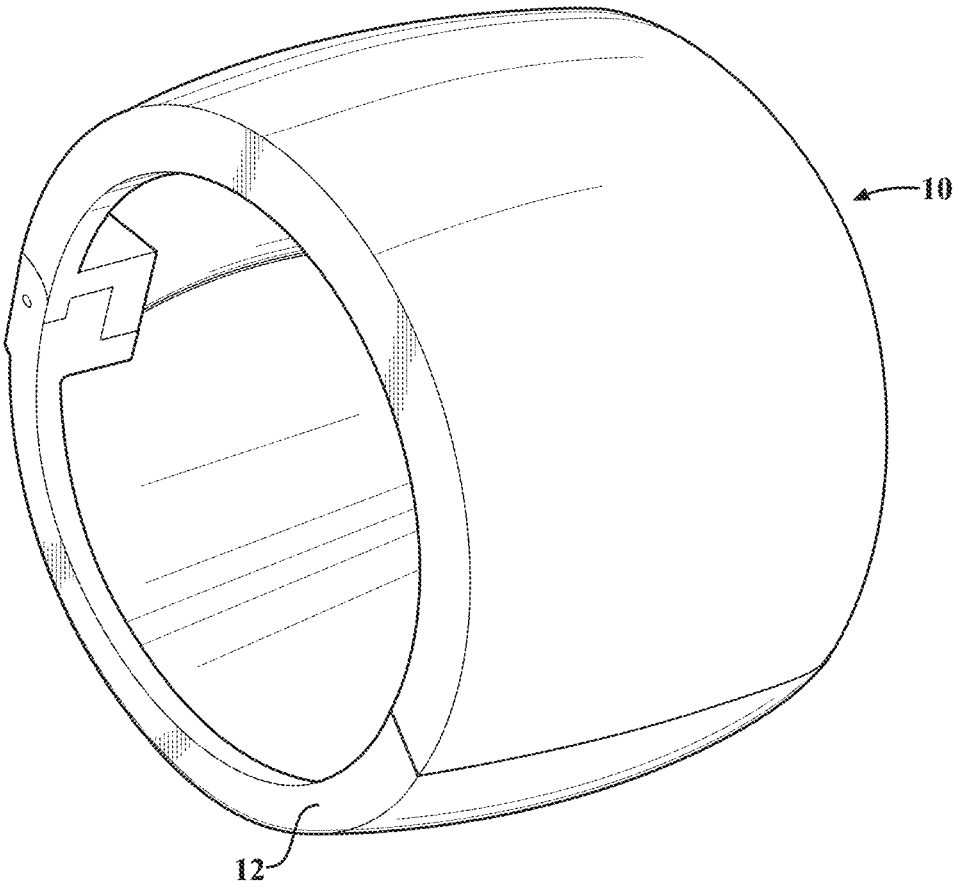
FIG. 1 is a perspective drawing of the cigar band.
Figure 2:
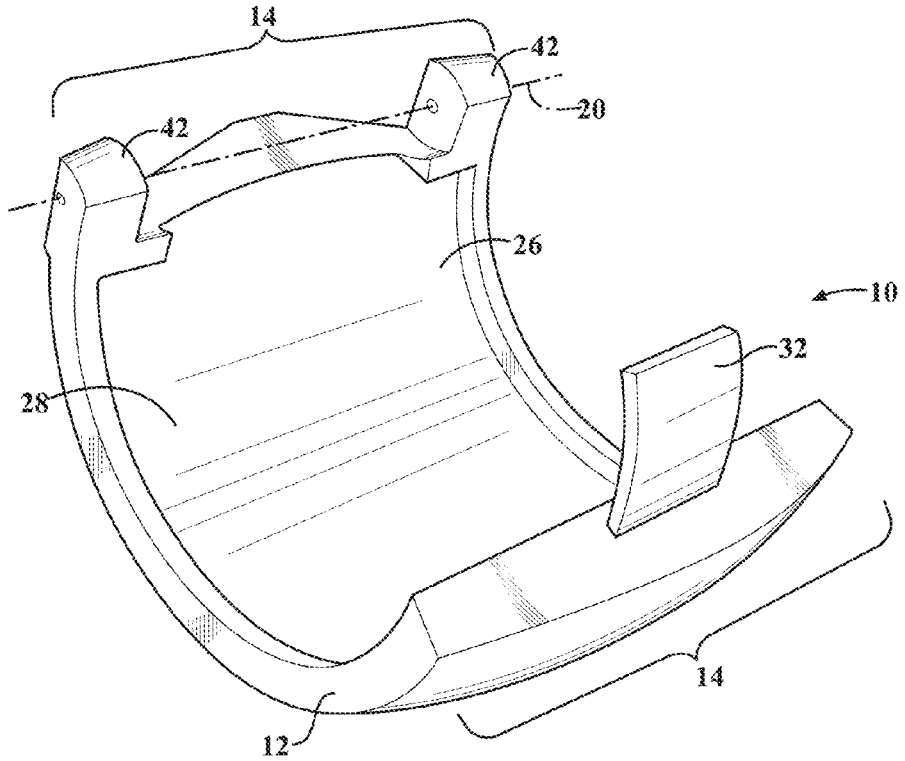
FIG. 2 is a perspective drawing of one half of the cigar band.
Figure 3:
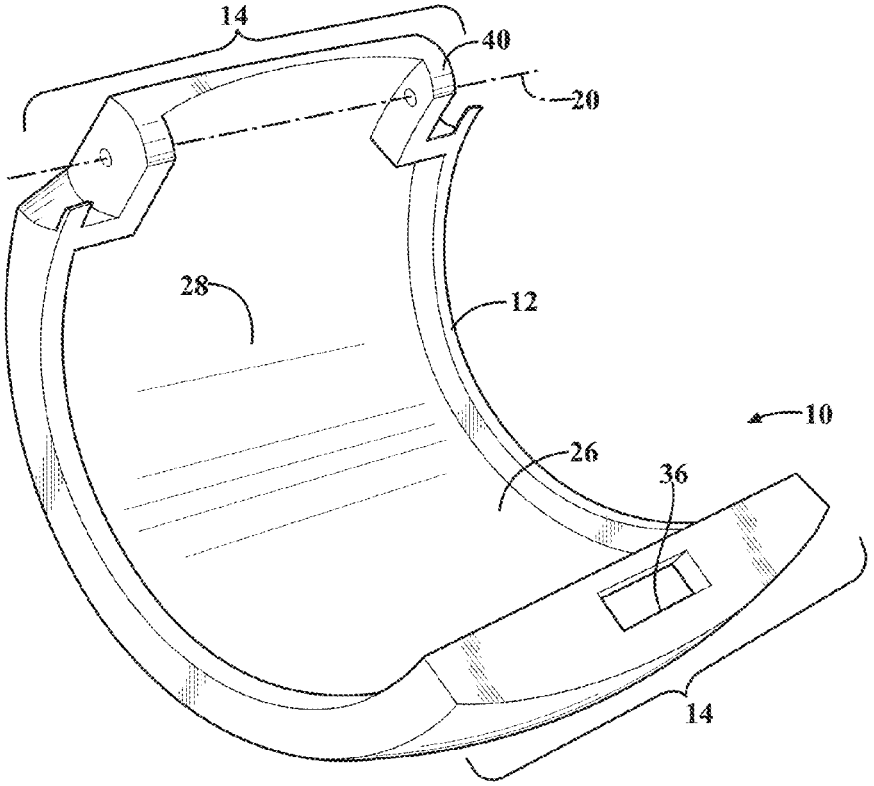
FIG. 3 is a perspective drawing of the opposite half of the cigar band.

FIG. 1 is a perspective drawing of the cigar band 10. FIG. 2 is a perspective drawing of one half 12 of the cigar band 10. FIG. 3 is a perspective drawing of the opposite half 12 of the cigar band 10.

The cigar band 10 comprises two annular-shaped halves 12, a clasp mechanism 16, a hinge mechanism 18, and at least one spring mechanism 22. The clasp mechanism 16 is along one side edge 14 of each annular-shaped half 12 and is configured to allow for the separation and union of the two halves 12 along the one side edge 14. The clasp mechanism 16 serves to lock the cigar band 10 in place and hold the cigar within the cavity defined by the two annular-shaped halves 12. The clasp mechanism 16 can encompass the entire side edge 14 or only a portion of the side edge 14.

The hinge mechanism 18 is along the opposing side edge 14 of each annular-shaped half 12 and is configured to allow for the movement of the two halves 12 about the axis 20. The cigar band 10 may have alternate positions for the axis 20 depending on the design of the hinge mechanism 18. Furthermore, the cigar band 10 may lack a hinge mechanism 18 altogether and integrate two clasp mechanisms 16 or at least one magnet.

Figure 8:
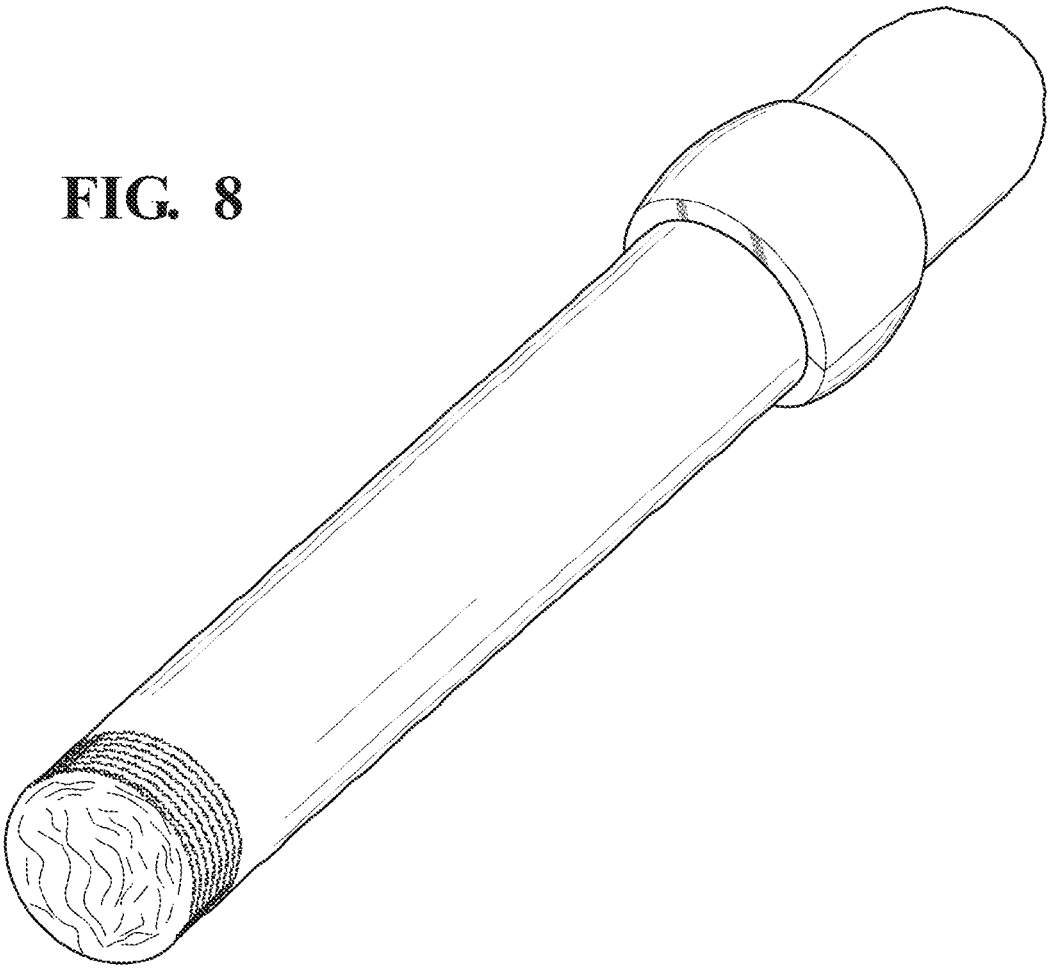
FIG. 8 is an environmental view of the cigar band including a cigar.

The cigar band 10 also has at least one spring mechanism 22 attached to at least one annular-shaped half 12. The spring mechanism 22 may have several different design forms in order to accommodate different cigars and alternate positioning of the cigar band 10 over the cigar once the cigar band 10 is closed. The cigar band 10 is configured to open about the axis 20 and maintain a cigar within the space defined by the two annular-shaped halves 12 as a result of the pressure of the at least one spring mechanism 22 once the cigar band 10 is closed. FIG. 8 shows an environmental view of a cigar within the cigar band 10 once it is closed.

As shown within FIGS. 1 through 3, in one embodiment at least one annular-shaped half 12 may include a dome recess 26 along its circumference. The dome recess 26 defines a concave cavity 28 where the at least one spring mechanism 22 may reside. This allows for the complete enclosure of a cigar by the cigar band 10 while still maintaining pressure against the cigar with the spring mechanism 22 within the space defined by the two annular shaped halves 12. In an alternative embodiment, the annular-shaped halves may lack the dome recess 26 and the spring mechanism 22. In such an embodiment the cigar band 10 may directly stay on a cigar by way of a pressure fit when the annular-shaped halves 12 are closed.

As shown in FIGS. 1 through 3, the clasp mechanism 16 may comprise one annular-shaped half 12 having a clasp insert 32 extending from one side edge 14 and the opposing annular-shaped half 12 having an opening 36 configured to receive the clasp insert 32 along the corresponding opposing side edge 14. With this embodiment the cigar band 10 is configured to lock through the insertion of the clasp insert 32 into the opening 36. The interaction between the clasp insert 32 and the opening 36 may be a pressure fit or a lock between the clasp insert 32 and the opening 36. An alternative embodiment of the clasp mechanism 16 may also utilize magnets (not shown) along one side edge 14. In this embodiment the cigar band 10 is configured to lock through the placement of the side edges 14 within proximity to each other. The magnet may be along the side edge 14 of both of the annular-shaped halves 12 or on only one annular shaped half 12.

FIGS. 1 through 3 also show the hinge mechanism 18 comprising one annular-shaped half 12 having a central hinge component 40 extending from the one side edge 14 and the opposing annular-shaped half 12 having two corresponding hinge components 42 extending from the one side edge 14 along the top circumference and the bottom circumference of the opposing annular-shaped half 12. Here, the central hinge component 40 configured to fit in between the two corresponding hinge components 42 and allow for the movement of the two annular-shaped halves 12 about the axis 20. The hinge components 40/42 may also be designed with a pressure fit in order to provide an additional secure fit around a cigar. A tight pressure fit may also alleviate the need for a clasp mechanism 16 along the opposing side edges 14 of the cigar band 10.

In another embodiment within the present disclosure each annular-shaped half 12 is the same height. This is to emulate the look of traditional cigar bands. Each annular-shaped half 12 may also be a consistent height along the circumference of the annular-shaped half 12 in order to further emulate the look of a traditional cigar band. Alternatively, each annular-shaped half 12 may be a different height. This would allow for alternative cigar band designs by modifying the halves 12 to be different from each other. Cigar halves 12 with inconsistent heights would allow for more tapered cigar band designs and reduction in materials while still maintaining the functionality of the cigar band 10.

Figure 4:
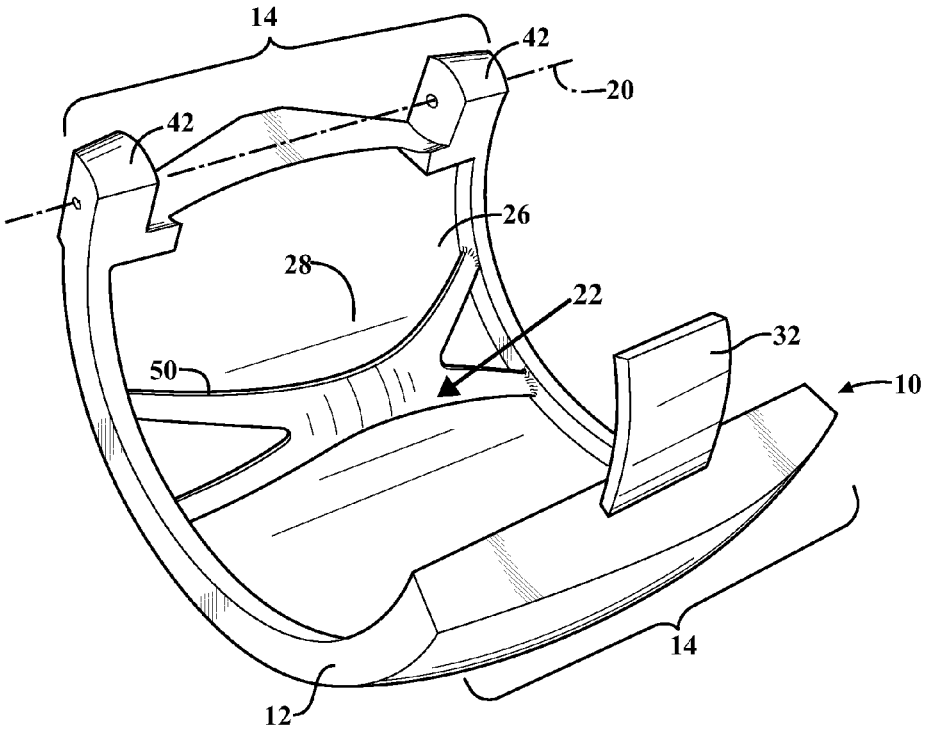
FIG. 4 is a perspective drawing of one of the halves including an embodiment of a spring mechanism.

In another embodiment of the cigar band 10, as shown in FIG. 4, the spring mechanism 22 comprises a double-y shaped design 50. The double Y-shaped design 50 consists of two y-shaped prongs connected by four contact points within the concave cavity 28 of at least one annular-shaped half 12. This design is configured to maintain a cigar within the space defined by the two annular-shaped halves 12 as a result of the pressure of the at least one spring mechanism. The double Y-shape design 50 may be recessed within a dome recess 26 in order to shield the spring mechanism 22 from view or extended out from a flat annular shaped half 12. The spring mechanism 22 used without a dome recess 26 would generate a suspended appearance of the cigar within the cigar band 10.

Figure 5:
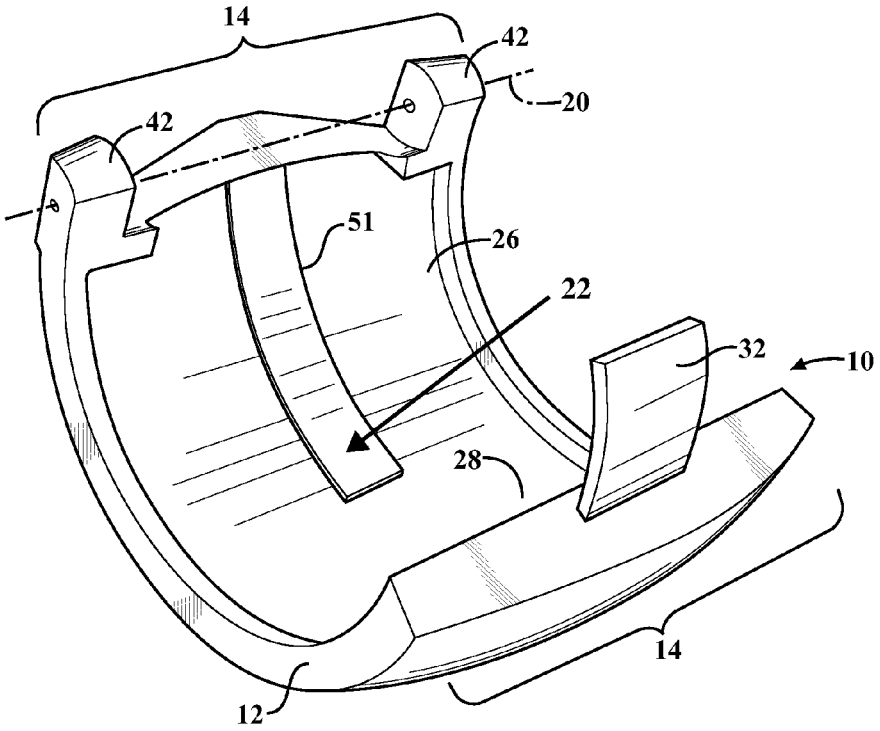
FIG. 5 is a perspective drawing of one of the halves including another embodiment of the spring mechanism.

In another embodiment of the cigar band 10, as shown in FIG. 5, the spring mechanism 22 comprises a spring foil 51 extending within the concave cavity 28 of at least one annular-shaped half 12. The spring foil 51 is configured to maintain a cigar within the space defined by the two halves 12 as a result of the pressure against the cigar by the spring foil 51.

This disclosure also provides a cigar band 10 comprising two annular-shaped halves 12, a clasp mechanism 16, and a hinge mechanism 18. The clasp mechanism 16 is along one side edge 14 of each annular-shaped half 12 and is configured to allow for the separation and union of the two annular-shaped halves along the one side 14. The hinge mechanism 18 is along the opposing side 14 of each annular-shaped half 12 and is configured to allow for the movement of the two annular-shaped halves 12 about an axis 20. The cigar band 10 is configured to maintain a cigar within the space defined by the two annular-shaped halves 12 once the cigar band 10 is closed.

Figure 6:
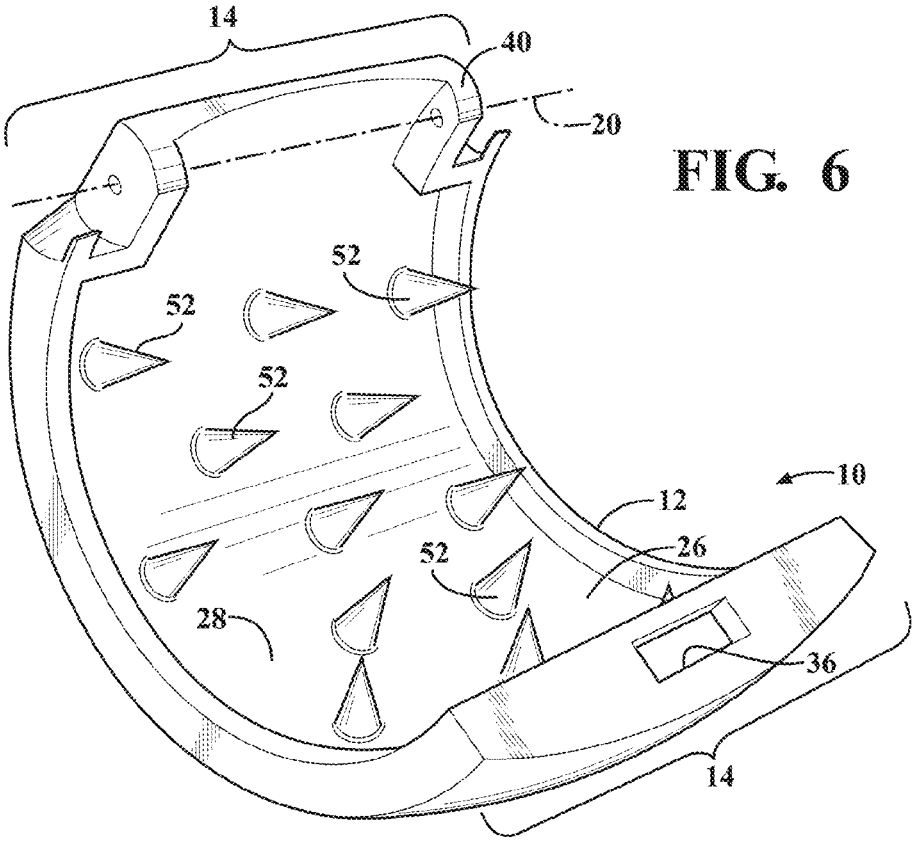
FIG. 6 is a perspective drawing of one of the halves including the plurality of spikes as described within the disclosure.

In another embodiment, as shown in FIG. 6, the cigar band 10 includes a plurality of spikes 52 extending from the concave cavity of at least one annular-shaped half 12, each spike 52 extending towards the center of the cigar band 10. The spikes 52 are configured to maintain a cigar within the space defined by the two annular-shaped halves as a result of the pressure applied by the plurality of spikes 52. Additional extended shapes may also be used including small domes, ridges, and/or any other extendable shape by that make apply pressure to the cigar within the cigar band 10. Unlike the spring mechanism 22 above, the spikes 52 are generally fixed and may not have the flexibility of the spring mechanism 22.

Figure 7:
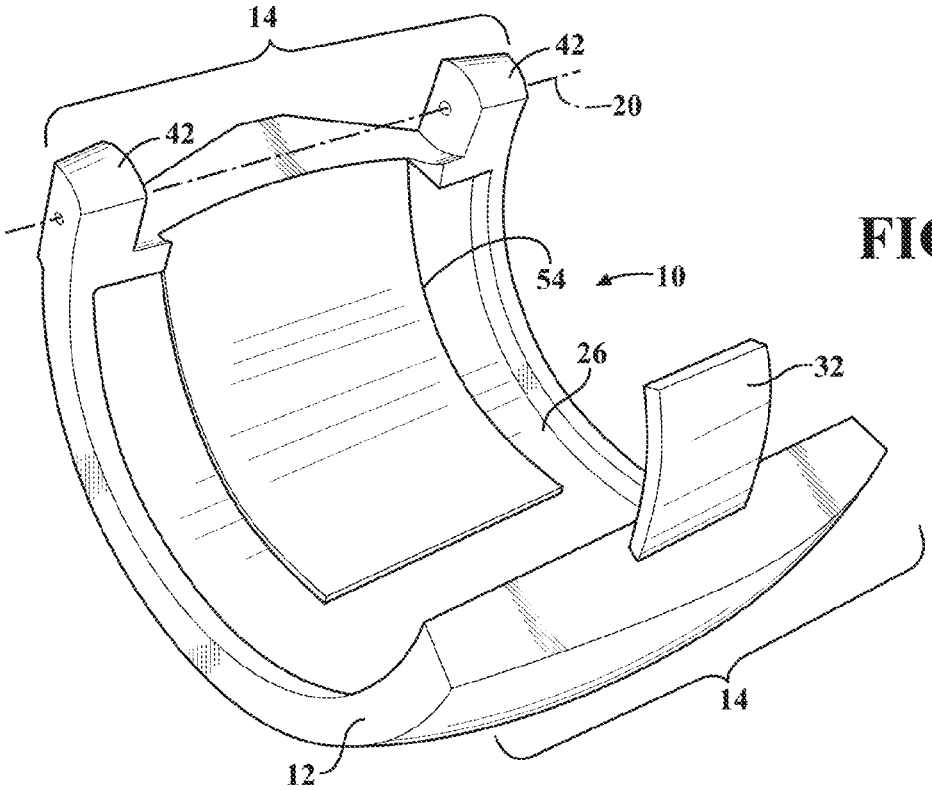
FIG. 7 is perspective drawing of one of the halves including the secondary half as described within the disclosure.

In another embodiment, as shown in FIG. 7, the cigar band 10 includes two secondary halves 54. Each secondary half 54 is fitted within the concave cavity 28 of each annular-shaped half and configured to maintain a cigar within the space defined by the cigar band 10 as a result of the pressure applied by the secondary halves 54. The secondary halves may be made of the same material as the annular-shaped halves 12 or of a different material. The secondary halves 54 may also be permanently fixed or removable from the cigar band 10. Removable secondary halves 54 may have different thickness in order to adjust to different cigar gauges. This ensures that the cigar band 10 may be used with multiple cigars. The secondary halves 54 may be composed of metals, composites, or any materials deemed safe for use with the consumption of a lit cigar. Additional materials such as rubber or plastic may also be used in order to maintain the cigar band 10 on display over a cigar prior to or during use.

This disclosure also provides a cigar band 10 comprising two annular-shaped halves 12, a magnet, and at least one spring mechanism 22. The magnet is along the side edge 14 of at least one annular-shaped half 12 and is configured to lock through the placement of the annular-shaped halves 12 within proximity to one another. The at least one spring mechanism 22 is attached to at least one annular-shaped half 12. The cigar band 10 is configured to maintain a cigar within the space defined by the two annular-shaped halves 12 as a result of the pressure of the at least one spring mechanism 22 once the cigar band 10 is closed. Within this embodiment both the clasp mechanism 16 and the hinge mechanism 18 are replaced with magnets along each side edge 14. The cigar band may only have one magnet, utilizing a dove-tail in order to lock the opposing side of the cigar band 10. Two magnets (one on each annular-shaped half 12) as well as four magnets total may be used.

The cigar band 10 and secondary bands 54 may be made of any non-toxic metal or material including, but not limited to, gold, platinum, silver, aluminum, and or titanium. Alloys and or composites may also be used. The cigar band 10 may also be constructed from any flame-resistant materials including glass, ceramic, and/or fire resistance plastic materials.

Exemplary embodiments of these systems and methods are described above in detail. The systems and methods are not limited to the specific embodiments described herein, but rather, components of the systems and/or steps of the methods may be utilized independently and separately from other components and/or steps described herein. For example, the systems may also be used in combination with other systems and methods, and is not limited to practice with only the system and method as described herein.

The order of execution or performance of the operations in the embodiments within the disclosure illustrated and described herein is not essential, unless otherwise specified. That is, the operations described herein may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the disclosure.

This written description uses examples within this disclosure, including the best mode, and also to enable any person skilled in the art to practice the subject matter within the disclosure, including making and using any devices or systems and performing any incorporated methods. The patentable scope of the invention is defined by the claims, and may include other examples that occur to those skilled in the art. Other aspects and features within the present disclosure may be obtained from a study of the drawings, the specification, and the appended claims. The subject matter of the present disclosure may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of within the disclosure may be shown in some drawings and not in others, this is for convenience only. In accordance with the principles of the subject matter within the disclosure, any feature of a drawing may be referenced and/or claimed in combination with any feature of any other drawing.

What is claimed is:

1. A cigar band comprising:

two annular-shaped halves, each half composed of a rigid, fire-resistant material, wherein each annular-shaped half includes an inner concave cavity extending along the inner circumference of the annular-shaped half defining a arcuate inner wall of the annular-shaped half;

a clasp mechanism along one side edge of each annular-shaped half, the clasp mechanism configured to allow for the separation and union of the two halves along the one side edge, the union of the two halves defining a circular cigar holding cavity;

a hinge mechanism along the opposing side edge of each annular-shaped half, the hinge mechanism configured to allow for the movement of the two halves about an axis; and at least one spring mechanism attached to the arcuate inner wall of at least one annular-shaped half, the at least one spring mechanism also composed of a fire-resistant material and extending radially inward within the inner concave cavity at a contact surface, the contact surface being biased in the general direction of a center of the cigar holding cavity by the spring mechanism, wherein the cigar band is configured to open about the axis and maintain a cigar within the cigar holding cavity defined by the two annular-shaped halves as a result of the pressure applied by the spring mechanism through contact between the contact surface of the at least one spring mechanism and a cigar in the cigar holding cavity responsive to the union of the two halves.

2. The cigar band of claim 1, wherein the spring mechanism transverses across the arcuate inner wall of the inner concave cavity.

3. The cigar band of claim 1, wherein the clasp mechanism comprises one annular-shaped half having a clasp insert extending from the one side edge and the opposing annular-shaped half having an opening configured to receive the clasp insert along the corresponding opposing side edge, wherein the cigar band is configured to lock responsive to the insertion of the clasp insert into the opening.

4. The cigar band of claim 1, wherein the clasp mechanism comprises each of the two annular-shaped halves having a magnet along one side edge, wherein the cigar band is configured to lock through the placement of the side edges within proximity to each other.

5. The cigar band of claim 1, wherein the hinge mechanism comprises one annular-shaped half having a central hinge component extending from the one side edge and the opposing annular-shaped half having two corresponding hinge components extending from the one side edge along the top circumference and the bottom circumference of the opposing annular-shaped half, the central hinge component configured to fit in between the two corresponding components and allow for the movement of the two annular-shaped halves about an axis.

6. The cigar band of claim 1, wherein both annular-shaped halves are the same height.

7. The cigar band of claim 1, wherein each annular-shaped half is a consistent height along the circumference of the half.

8. The cigar band of claim 1, wherein each annular-shaped half is a different height.

9. The cigar band of claim 1, wherein the spring mechanism comprises a double-y shaped design, said design consisting of two y-shaped prongs connected to the arcuate inner wall by four contact points within the concave cavity of at least one annular-shaped half and configured to maintain a cigar within the space defined by the two annular-shaped halves as a result of the pressure of the cigar contacting the contact surface of the at least one spring mechanism.

10. The cigar band of claim 2, wherein the spring mechanism comprises a spring foil extending within the concave cavity of at least one annular-shaped half and configured to maintain a cigar within the space defined by the two halves as a result of the pressure of the at least one spring mechanism.

11. A cigar band comprising:

two annular-shaped halves, each half composed of a rigid, fire-resistant material wherein at least one annular-shaped half includes a dome recess along its outer circumference and an inner concave cavity extending along the inner circumference defining an arcuate inner wall of each half;

a clasp mechanism along one side edge of each annular-shaped half, the clasp mechanism configured to allow for the separation and union of the two annular-shaped halves along the one side, the union of the two halves defining a cigar holding cavity;

a hinge mechanism along the opposing side of each annular-shaped half, the hinge mechanism configured to allow for the movement of the two annular-shaped halves about an axis, wherein the cigar band is configured to open about the axis and maintain a cigar within the cigar holding cavity defined by the two annular-shaped halves once the cigar band is closed; and at least one cigar holding mechanism attached to at least one annular-shaped half, the at least one cigar holding mechanism being of a fire-resistant material and including a first end, a second end and an intermediate portion between the first and second ends, wherein the first and second ends are attached to the inner wall of the inner concave cavity and the intermediate position extending in a generally axial direction within the inner concave cavity of the at least one annular-shaped half, the intermediate portion of the cigar holding mechanism including a contact surface, the contact surface being positioned within the inner concave cavity and being at least one of spring-biased and biased by the union of the two annular-shaped halves to come into contact with a cigar in the cigar holding cavity once the cigar band is closed.

12. The cigar band of claim 11, each annular-shaped half including a dome recess along its outer circumference, the dome recess defining the opposing inner concave cavity.

13. The cigar band of claim 11, wherein the clasp mechanism comprises one annular-shaped half having a clasp insert extending from the one side edge and the opposing annular-shaped half having an opening configured to receive the clasp insert along the corresponding opposing side edge, wherein the cigar band is configured to lock thru the insertion of the clasp insert into the opening.

14. The cigar band of claim 11, wherein the clasp mechanism comprises the two annular-shaped halves having a magnet along one side edge, wherein the cigar band is configured to lock thru the placement of the side edges within proximity to each other.

15. The cigar band of claim 12, the cigar band including a plurality of spikes extending from the concave cavity of at least one annular-shaped half, each spike composed of a fire-resistant material and extending towards the center of the cigar band and wherein the spikes are configured to maintain a cigar within the space defined by the two annular-shaped halves as a result of the pressure applied by the plurality of spikes.

16. The cigar band of claim 12, the cigar band including two secondary halves, each secondary half composed of a fire-resistant material and fitted within the concave cavity of each annular-shaped half and configured to maintain a cigar within the space defined by the cigar band as a result of the pressure applied by the secondary halves.

17. The cigar band of claim 16, wherein the two secondary halves are composed of a different material than the two annular-shaped halves.

18. A cigar band comprising:

two annular-shaped halves, each half composed of a rigid, fire-resistant material, wherein at least one annular-shaped half includes a dome recess along its inner circumference, the dome recess defining an inner concave cavity along the inner circumference;

a magnet along the side edge of at least one annular-shaped half, the magnet configured to engage through the placement of the annular-shaped halves within proximity to one another, the engagement of the two halves defining a cigar holding cavity; and at least one spring mechanism attached to at least one annular-shaped half, the at least one spring mechanism composed of a fire-resistant material and extending axially across the inner concave cavity defined by the dome recess, the at least one spring mechanism including a first end, a second end and a planar contact surface being between the first and second ends, wherein the first and second ends are attached to axially opposing sides of the inner concave cavity, the contact surface being positioned within the inner concave cavity and spring-biased in the general direction of a center of the cigar holding cavity, wherein the cigar band is configured to maintain a cigar within the cigar holding cavity defined by the two annular-shaped halves as a result of the pressure applied through the spring-biased contact between the planar contact surface of the at least one spring mechanism and a cigar in the cigar holding cavity once the cigar band is closed.

* * * * *